US007565801B2

(12) United States Patent
Tozawa et al.

(10) Patent No.: US 7,565,801 B2
(45) Date of Patent: Jul. 28, 2009

(54) SWING DRIVE DEVICE AND WORK MACHINE

(75) Inventors: Shoji Tozawa, Tokyo (JP); Madoka Binnaka, Tokyo (JP); Hideto Furuta, Tokyo (JP)

(73) Assignee: Caterpillar Japan Ltd., Tokyo (JP)

( * ) Notice: Subject to any disclaimer, the term of this patent is extended or adjusted under 35 U.S.C. 154(b) by 289 days.

(21) Appl. No.: 11/573,866

(22) PCT Filed: Apr. 10, 2006

(86) PCT No.: PCT/JP2006/307534

§ 371 (c)(1),
(2), (4) Date: Feb. 16, 2007

(87) PCT Pub. No.: WO2006/132031

PCT Pub. Date: Dec. 14, 2006

(65) Prior Publication Data

US 2008/0314038 A1 Dec. 25, 2008

(30) Foreign Application Priority Data

Jun. 6, 2005 (JP) ..... 2005-166174
Jun. 6, 2005 (JP) ..... 2005-166181

(51) Int. Cl.
*F16D 31/02* (2006.01)

(52) U.S. Cl. ..... 60/414; 60/424; 60/484; 60/486

(58) Field of Classification Search ..... 60/414, 60/417, 424, 484, 486, 488
See application file for complete search history.

(56) References Cited

U.S. PATENT DOCUMENTS

| | | | | |
|---|---|---|---|---|
| 5,203,168 | A * | 4/1993 | Oshina et al. | 60/488 |
| 6,666,022 | B1 * | 12/2003 | Yoshimatsu et al. | 60/414 |
| 7,086,226 | B2 * | 8/2006 | Oguri | 60/414 |
| 2005/0036894 | A1 | 2/2005 | Oguri | |

FOREIGN PATENT DOCUMENTS

| | | |
|---|---|---|
| JP | 56-006901 | 1/1981 |
| JP | 11-141504 | 5/1999 |
| JP | 2000-273913 | 10/2000 |
| JP | 2003-120616 | 4/2003 |
| JP | 2004-084470 | 3/2004 |
| JP | 2004-190845 | 7/2004 |
| JP | 4065173 | 1/2008 |

OTHER PUBLICATIONS

International Search Report for PCT/JP2005/307534 mailed May 23, 2006.

* cited by examiner

*Primary Examiner*—Michael Leslie
(74) *Attorney, Agent, or Firm*—Darby & Darby P.C.

(57) ABSTRACT

A swing control circuit is provided separately from a hydraulic actuator control circuit. The swing control circuit includes a swing pump motor connected to closed circuits of a swing motor through a solenoid valve that serves as a directional control valve. A swing motor generator is connected to the swing pump motor. The swing motor generator is connected to an electric power storage device of a hybrid type drive system. An exterior-connecting passage for feeding hydraulic fluid to hydraulic actuators of a lower structure and a work equipment is drawn from a pipeline between the swing pump motor and the solenoid valve. A connecting passage solenoid valve is disposed in the exterior-connecting passage. The invention enables hydraulic energy generated in the swing system to be directly fed to the outside of the swing system.

5 Claims, 2 Drawing Sheets

SWING DRIVE DEVICE AND WORK MACHINE

CROSS REFERENCE TO PRIOR APPLICATION

This is a U.S. national phase application under 35 U.S.C. § 371 of International Patent Application No. PCT/JP2006/307534 filed Apr. 10, 2006 and claims the benefit of Japanese Application Nos. 2005-166174 filed Jun. 6, 2005 and 2005-166181 filed Jun. 6, 2005, all of which are incorporated by reference herein. The International Application was published in Japanese on Dec. 14, 2006 as WO 2006/132031 a1 under PCT article 21(2).

TECHNICAL FIELD

The present invention relates to a swing drive device provided with a swing motor adapted to drive a load for performing swinging operation by receiving hydraulic fluid. The present invention also relates to a work machine of which an upper structure is adapted to be rotated on a lower structure by such a swing drive device.

BACKGROUND

When using a hybrid type drive device in a work machine, such as a hydraulic excavator, it is a common practice to use an electric motor as a swing actuator for rotating the upper structure on the lower structure by means of a deceleration device to perform swinging operation (e.g. See Japanese Laid-open Patent Publication No. 2004-190845 (page 6, FIG. 1)

SUMMARY OF THE INVENTION

As the upper structure exerts a great inertial force, its electric motor functions as a generator when performing braking of swinging motion. Therefore, it is possible to store swinging motion energy in the form of electric energy in an electric power storage device. However, in cases where actuators other than those of the swing system are hydraulic actuators, which are adapted to function by receiving hydraulic fluid, it is not possible to feed excess energy generated in the swing system from the swing system directly to a hydraulic actuator that is not of the swing system.

In order to solve the above problem, an object of the invention is to provide a swing drive device that is capable of feeding hydraulic energy generated in the swing system directly to components outside the swing system. Another object of the invention is to provide a work machine that uses such a swing drive device.

The present invention relates to a swing drive device including a swing motor, a swing pump motor, a directional control valve, a swing motor generator, an electric power storage device, an exterior-connecting passage, a connecting passage solenoid valve, and a hydraulic fluid replenishment means. The swing motor serves to rotate a load for performing swinging operation by receiving hydraulic fluid. The swing pump motor is connected to the swing motor through a closed circuit and adapted to function as a pump for feeding hydraulic fluid to the swing motor and also function as a hydraulic motor driven by hydraulic fluid discharged from the swing motor. The directional control valve has a neutral position, at which the directional control valve interrupts the passage between the swing pump motor and the swing motor, and a directional control position. When rotation of the load is being braked, the swing motor generator is driven by the swing pump motor functioning as a hydraulic motor so that the swing motor generator functions as a generator. The swing motor generator is also adapted to receive electric power so as to function as an electric motor to drive the swing pump motor as a pump. The electric power storage device serves to store electric power fed from the swing motor generator functioning as a generator, as well as feed electric power to the swing motor generator functioning as an electric motor. The exterior-connecting passage serves to feed hydraulic fluid from the aforementioned closed circuit between the swing pump motor and the directional control valve to components outside the swing system. The connecting passage solenoid valve is disposed in the exterior-connecting passage and adapted to be moved between a position for enabling the supply of fluid to the components outside the swing system and a position for interrupting the flow of fluid. The hydraulic fluid replenishment means serves to replenish hydraulic fluid in the closed circuit between the swing pump motor and the directional control valve.

The present invention relates to a swing drive device described above, wherein a hydraulic fluid replenishment pump serves as the hydraulic fluid replenishment means.

An embodiment of the present invention relates to a work machine having a lower structure, an upper structure that is rotatable on the lower structure by a swing motor functioning by receiving hydraulic fluid, and a work equipment mounted on the upper structure, wherein the work machine further includes a hybrid type drive system, a hydraulic actuator control circuit, and a swing drive device. The hybrid type drive system includes an engine, a motor generator, an electric power storage device, and a main pump. The motor generator is adapted to be driven by the engine so as to function as a generator as well as receive electric power so as to function as an electric motor. The electric power storage device serves to store electric power fed from the motor generator functioning as a generator, as well as feed electric power to the motor generator functioning as an electric motor. The main pump is adapted to be driven either one of or both the engine and the motor generator. The hydraulic actuator control circuit serves to control hydraulic fluid fed from the main pump of the hybrid type drive system to hydraulic actuators of the lower structure and the work equipment. The swing drive device serves to rotate the upper structure by controlling hydraulic fluid fed to the swing motor.

Another embodiment of the present invention relates to a work machine described above, wherein the lower structure is provided with a travel motor adapted to function by receiving hydraulic fluid; the work equipment comprises a boom, a stick, and a bucket that are sequentially connected and adapted to be pivoted by a boom cylinder, a stick cylinder and a bucket cylinder respectively; the hydraulic actuator control circuit serves to control hydraulic fluid fed from the main pumps of the hybrid type drive system to the travel motor of the lower structure as well as to the boom cylinder, the stick cylinder, and the bucket cylinder of the work equipment; and the exterior-connecting passage is connected to a discharge passage of the main pump, which serves to feed hydraulic fluid to the boom cylinder, the stick cylinder, and the travel motor.

A further embodiment of the present invention relates to a work machine above, wherein the hydraulic actuator control circuit has a boom assist pump, an energy recovery motor, a boom motor generator, and a clutch. The boom assist pump serves to assist flow rate of hydraulic fluid fed from the main pump of the hybrid type drive system to the boom cylinder. The energy recovery motor is provided in a return passage through which return fluid discharged from the boom cylinder flows. The boom motor generator is adapted to be driven by the energy recovery motor so as to function as a generator for feeding electric power to the electric power storage device of the hybrid type drive system as well as be driven by electric power fed from the electric power storage device so as to function as an electric motor. The clutch serves to transmit electric power from the boom motor generator functioning as an electric motor to the boom assist pump and disengage the boom motor generator functioning as a generator from the boom assist pump.

Another embodiment relates to a work machine, as above, wherein the hydraulic actuator control circuit further includes a circuit-to-circuit communicating passage between stick and boom, and a solenoid valve between stick and boom. The circuit-to-circuit communicating passage between stick and boom provides fluid communication between a hydraulic fluid feeding passage for the stick cylinder and the head-side of the boom cylinder. The solenoid valve between stick and boom is disposed in the circuit-to-circuit communicating passage between stick and boom and adapted to be moved between a position for enabling flow in one direction from the hydraulic fluid feeding passage for the stick cylinder to the head-side of the boom cylinder and a position for interrupting the flow of fluid.

A further embodiment relates to a work machine described above, wherein the hydraulic actuator control circuit further includes a boom cylinder hydraulic fluid feeding passage, a bucket cylinder hydraulic fluid feeding passage, a stick cylinder hydraulic fluid feeding passage, a boom assist pump, a solenoid valve between bucket and boom, a circuit-to-circuit communicating passage between bucket and stick, a solenoid valve between bucket and stick, a pump-to-pump communicating passage, and a solenoid valve between pumps; and a first main pump and a second main pump are provided and serve as the aforementioned main pump. The boom cylinder hydraulic fluid feeding passage is provided for feeding hydraulic fluid from the first main pump to the boom cylinder. The bucket cylinder hydraulic fluid feeding passage branches off the boom cylinder hydraulic fluid feeding passage and serves to feed hydraulic fluid to the bucket cylinder. The stick cylinder hydraulic fluid feeding passage serves to feed hydraulic fluid from the second main pump to the stick cylinder. The boom assist pump, together with the first main pump, serves to feed hydraulic fluid to the boom cylinder. The solenoid valve between bucket and boom is disposed in the boom cylinder hydraulic fluid feeding passage, at a location between the branching point of the bucket cylinder hydraulic fluid feeding passage and a point at which a passage from the boom assist pump joins the boom cylinder hydraulic fluid feeding passage. The solenoid valve between bucket and boom is adapted to be moved between a position for enabling the hydraulic fluid that would otherwise be fed to the bucket cylinder to be fed to the boom cylinder in a one-way direction and a position for interrupting the flow of fluid. The circuit-to-circuit communicating passage between bucket and stick provides fluid communication between the bucket cylinder hydraulic fluid feeding passage and the stick cylinder hydraulic fluid feeding passage. The solenoid valve between bucket and stick is disposed in the circuit-to-circuit communicating passage between bucket and stick and adapted to be moved between a position for enabling flow in one direction from the bucket cylinder hydraulic fluid feeding passage for the stick cylinder and a position for interrupting the flow of fluid. The pump-to-pump communicating passage provides fluid communication between a discharge passage of the boom assist pump and the discharge passage of the first main pump. The solenoid valve between pumps is disposed in the pump-to-pump communicating passage and adapted to be moved between a position for enabling flow in one direction from the discharge passage of the boom assist pump to the discharge passage of the first main pump and a position for interrupting the flow of fluid.

According to an embodiment, when rotating a load to perform swing operation, the directional control valve is controlled to a directional control position, and the connecting passage solenoid valve is controlled to the flow interrupting position, thereby enabling the swing system to function independently. In this state, electric power is fed from the electric power storage device to drive the swing motor generator as an electric motor so that the swing pump motor functions as a pump, thereby generating hydraulic pressure. As the resulting hydraulic pressure drives the swing motor, the load can be rotated solely and independently by the swing system. When stopping the movement of the load, the swing motor rotated by inertial movement of the load discharges hydraulic fluid as a result of the pumping function of the swing motor, and the discharged hydraulic fluid operates the swing pump motor so that the swing pump motor functions as a hydraulic motor and drives the swing motor generator as a generator. It is thus possible to transform inertial motion energy of the load to electric energy, thereby effectively recovering electric power to the electric power storage device while braking rotation movement of the load. When the swing system does not require a great amount of hydraulic fluid, the connecting passage solenoid valve is controlled to the position for enabling the supply of fluid to the components outside the swing system, and, in this state, the swing motor generator, which is functioning as an electric motor by means of electric power from the electric power storage device, drives the swing pump motor as a pump. As a result, while being replenished with hydraulic fluid by the hydraulic fluid replenishment means, the swing pump motor is capable of discharging hydraulic fluid through the connecting passage solenoid valve and the exterior-connecting passage, from which the hydraulic fluid can be fed directly to the components that are outside the swing system and require the hydraulic. As the swing pump motor can function as a pump, the main pump can be made correspondingly compact.

According to the present invention, the hydraulic fluid replenishment pump is capable of forcibly replenishing hydraulic fluid to an intake side of the swing pump motor, thereby enabling the swing pump motor to feed hydraulic fluid to components outside the swing system with improved efficiency.

According to the present invention, when rotating the upper structure on the lower structure of the work machine to perform swing operation, the swing motor is driven by hydraulic pressure generated by the swing pump motor, which is driven by electric power fed from the electric power storage device of the hybrid type drive system through the swing motor generator. Thus, the upper structure can be rotated solely and independently by the swing system. When stopping the movement of the upper structure, the swing motor rotated by inertial movement of the upper structure discharges hydraulic fluid as a result of the pumping function of the swing motor, and the discharged hydraulic fluid operates the swing pump motor so that the swing pump motor functions as a hydraulic motor and drives the swing motor generator as a generator. It is thus possible to transform inertial motion energy of the upper structure to electric energy, thereby effectively recovering electric power to the electric power storage device of the hybrid type drive system while braking rotation movement of the upper structure. When the swing system does not require a great amount of hydraulic fluid, the swing motor generator functioning as an electric motor drives the swing pump motor as a pump. As a result, while being replenished with hydraulic fluid by the hydraulic fluid replenishment means, the swing pump motor is capable of discharging hydraulic fluid through the connecting passage solenoid valve and the exterior-connecting passage, from which the hydraulic fluid can be fed directly to the hydraulic actuator control circuit of the lower structure and the work equipment that requires the hydraulic fluid. As the swing pump motor can function as a pump, the main pump can be made correspondingly compact.

According to the present invention, the exterior-connecting passage is connected to the discharge passage of the main pump, which feeds hydraulic fluid to the boom cylinder, the stick cylinder, and the travel motor. Therefore, a sufficient amount of hydraulic fluid is fed from the main pump and the swing pump motor, which is functioning as a pump, to these hydraulic actuators.

According to the present invention, by disengaging the clutch, the energy recovery motor driven by return fluid discharged from the boom cylinder is enabled to efficiently input driving power to the boom motor generator, which is under no-load condition, resulting in the generated electric power being stored in the electric power storage device of the hybrid type drive system. It is thus possible to effectively recover energy of return fluid discharged from the boom cylinder. When the clutch is engaged, electric power fed from the electric power storage device enables the boom motor generator to function as an electric motor to drive the boom assist pump so that hydraulic fluid is fed from the boom assist pump to the boom cylinder. As a great amount of hydraulic fluid is thus fed to the boom cylinder not only from the main pump and the swing pump motor functioning as a pump but also from the boom assist pump, the speed of boom raising action is further increased, resulting in further increased working efficiency.

According to the present invention, the solenoid valve between stick and boom is disposed in the circuit-to-circuit communicating passage between stick and boom for providing fluid communication between the hydraulic fluid feeding passage for the stick cylinder and the head-side of the boom cylinder. Therefore, by opening this solenoid valve, supply of hydraulic fluid to the boom cylinder is ensured, thereby increasing the speed of boom raising action by the boom cylinder and improving working efficiency. Furthermore, supply of hydraulic fluid to the stick cylinder can be ensured by closing the solenoid valve.

According to the present invention, the solenoid valve between bucket and boom is disposed in the boom cylinder hydraulic fluid feeding passage. Therefore, by opening this solenoid valve, a combined amount of hydraulic fluid can be fed from the first main pump and the boom assist pump to the boom cylinder. Therefore, it is possible to increase the speed of boom raising action by the boom cylinder and improve working efficiency. Furthermore, a high pressure to the bucket cylinder can be ensured by closing the solenoid valve. As the solenoid valve between bucket and stick is disposed in the circuit-to-circuit communicating passage between bucket and stick, opening this solenoid valve ensures supply of hydraulic fluid to the stick cylinder is ensured, thereby increasing the speed of action of the stick cylinder and improving working efficiency. Furthermore, a high pressure to the bucket cylinder can be ensured by closing the solenoid valve. As the solenoid valve between pumps is provided in the pump-to-pump communicating passage, opening this solenoid valve enables the hydraulic fluid discharged from the boom assist pump to be combined with hydraulic fluid from the first main pump, thereby increasing the speed of action of the stick cylinder and other actuators, resulting in improved working efficiency. Furthermore, supply of hydraulic fluid to the boom cylinder can be ensured by closing the solenoid valve. As a result of the configuration according to the preset invention, which allows opening or closing of the connecting passage solenoid valve and the solenoid valve between stick and boom in addition to operation of the solenoid valves mentioned above, i.e. the solenoid valve between bucket and boom, the solenoid valve between bucket and stick, and the solenoid valve between pumps, the flexibility allowed in the combination of circuits that support each other with hydraulic fluid is increased, making it easy to cope with demands for a wide variety of operation patterns.

DETAILED DESCRIPTION OF THE INVENTION

Figure 1:
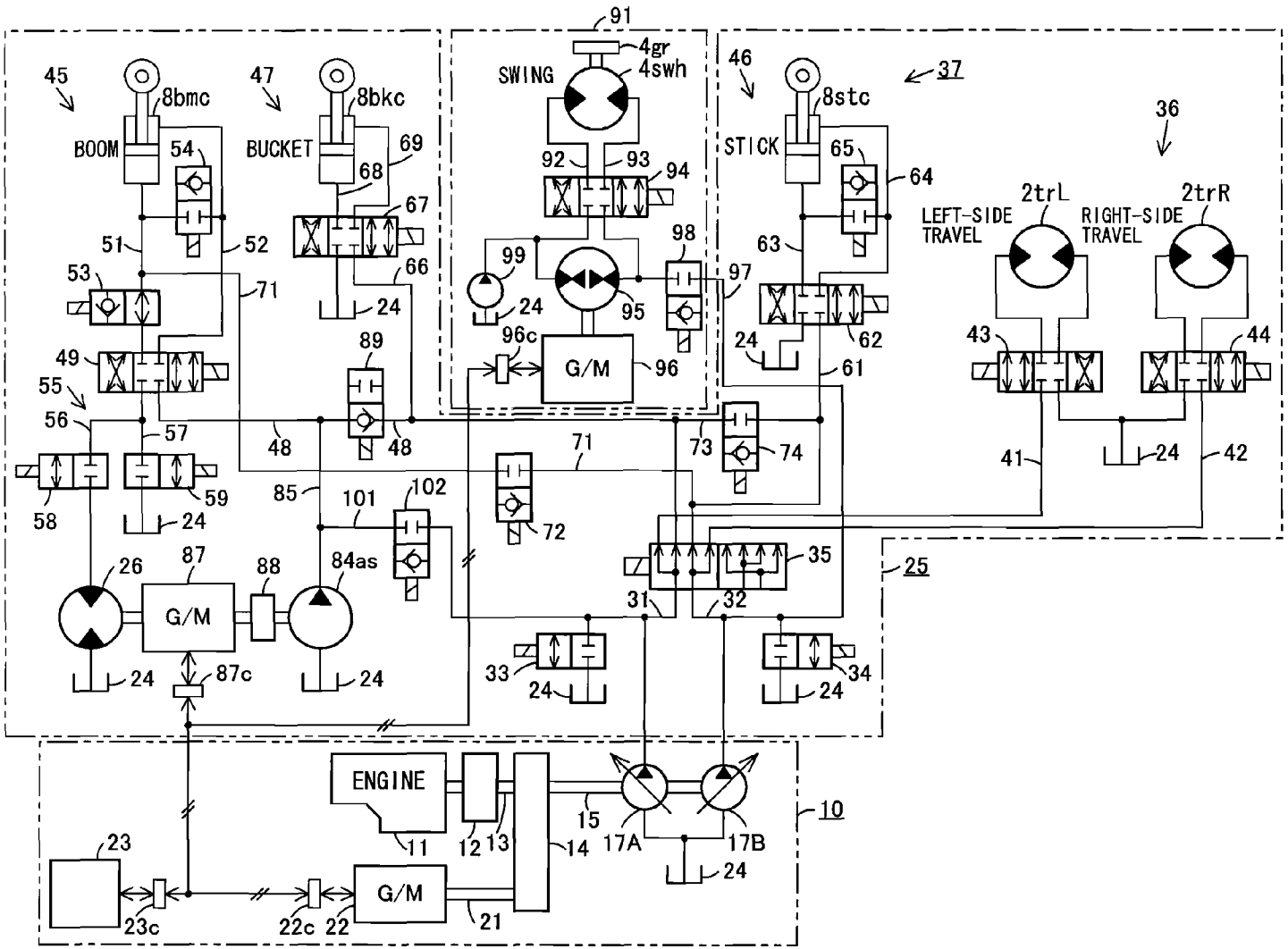
FIG. 1 is a circuit diagram showing a hydraulic actuator control circuit including a swing drive device according to an embodiment of the present invention.
Figure 2:
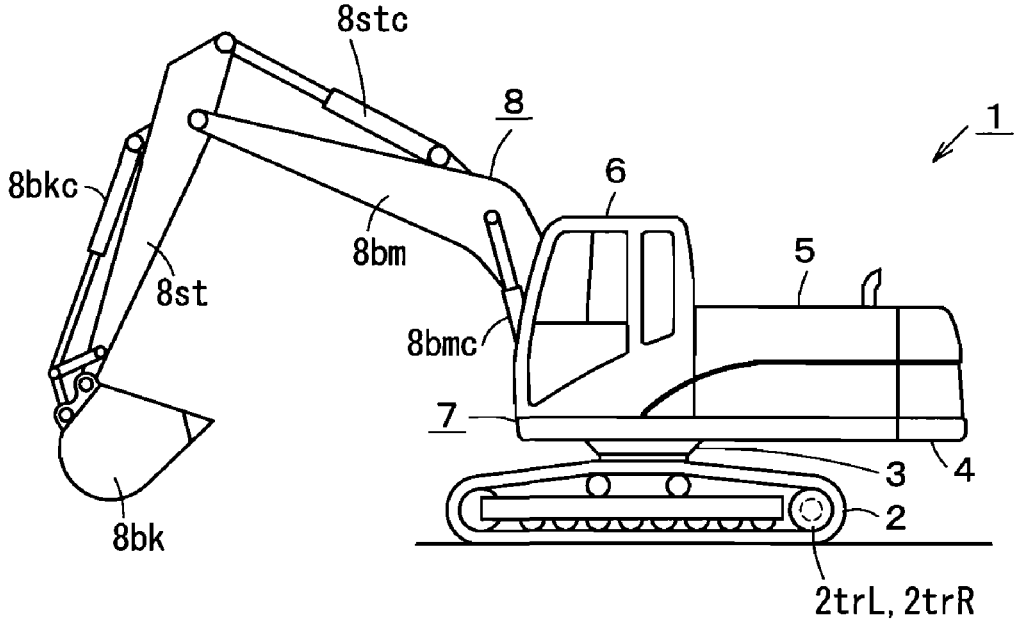
FIG. 2 is a side view of a work machine equipped with the aforementioned control circuit.

Next, the present invention is explained in detail hereunder, referring to an embodiment thereof shown in FIGS. 1 and 2. The fluid and fluid pressure used in this embodiment are oil and oil pressure, respectively.

As shown in FIG. 2, a work machine 1 is a hydraulic excavator that includes a machine body 7. The machine body 7 is comprised of a lower structure 2, an upper structure 4 rotatably mounted on the lower structure 2 with a swing bearing portion 3 therebetween, and components mounted on the upper structure 4. The components mounted on the upper structure 4 include a power unit 5 comprised of an engine, hydraulic pumps, etc., and a cab 6 for protecting an operator. The lower structure 2 is provided with travel motors 2*tr*L, 2*tr*R that serve as hydraulic actuators for respectively driving right and left crawler belts. The upper structure 4 is provided with a motor generator (not shown in FIG. 2) for driving a swing deceleration mechanism provided in the swing bearing portion 3.

A work equipment 8 is attached to the upper structure 4. The work equipment 8 comprises a boom 8*bm*, a stick 8*st*, and a bucket 8*bk* that are connected sequentially as well as pivotally by means of pins. The boom 8*bm* is attached to a bracket (not shown) of the upper structure 4 by means of pins. The boom 8*bm* can be pivoted by a boom cylinder 8*bmc*, which is a hydraulic actuator. The boom 8*bm* is attached to a bracket (not shown) of the upper structure 4 by means of pins. The stick 8*st* can be pivoted by a stick cylinder 8*stc*, which is a hydraulic actuator. The bucket 8*bk* can be pivoted by a bucket cylinder 8*bkc*, which is also a hydraulic actuator.

A hybrid type drive system 10 shown in FIG. 1 comprises an engine 11, a clutch 12, a power transmission unit 14, and two main pumps 17A, 17B of a variable delivery type. The clutch 12 is connected to the engine 11 and serves to transmit or interrupt rotational power output from the engine 11. An input axis 13 of the power transmission unit 14 is connected to the clutch 12, and an output axis 15 of the power transmission unit 14 is connected to the main pumps 17A, 17B.

A motor generator 22 is connected to an input/output axis 21 of the power transmission unit 14 so that the motor generator 22 is arranged in parallel with the engine 11 with respect to the main pumps 17A, 17B. The motor generator 22 is adapted to be driven by the engine 11 so as to function as a generator as well as receive electric power so as to function as an electric motor. The motor power of the motor generator 22 is set to be smaller than the engine power. A motor generator controller 22*c*, which may be an inverter or the like, is connected to the motor generator 22.

An electric power storage device 23, which may be a battery, a capacitor, or the like, is connected to the motor generator 22*c* through an electric power storage device controller 23*c*. The electric power storage device 23 serves to store electric power fed from the motor generator 22 functioning as a generator, as well as feed electric power to the motor generator 22 functioning as a motor.

The power transmission unit 14 of the hybrid type drive system 10 incorporates a continuously variable transmission mechanism, such as a toroidal type, a planetary gear type, etc., so that, upon receiving a control signal from outside, the power transmission unit 14 is capable of outputting rotation of continuously varying speed to its output axis 15.

The main pumps 17A, 17B of the hybrid type drive system 10 serve to feed hydraulic fluid, such as hydraulic oil, that is contained in a tank 24 to a hydraulic actuator control circuit 25. The hydraulic actuator control circuit 25 includes an energy recovery motor 26 so that when the energy recovery motor 26 drives a boom motor generator 87, electric power recovered by a generator controller 87*c* of the boom motor generator 87 is stored in the electric power storage device 23.

Speed of the engine 11, engagement/disengagement by the clutch 12, and speed change by the power transmission unit 14 are controlled basing on signals output from a controller (not shown).

The hydraulic actuator control circuit 25 shown in FIG. 1 includes pump passages 31, 32, which are respectively connected to output ports of the main pumps 17A, 17B. The pump passages 31, 32 are also respectively connected to solenoid valves 33, 34, which serve as proportional solenoid valves, as well as to a solenoid valve 35, which is adapted to function as a straight travel valve. The solenoid valves 33, 34 are disposed in a bypass passage for returning hydraulic fluid to the tank 24.

Each solenoid valve 33, 34 may function as a bypass valve. To be more specific, when there is no operating signal that signifies the operator operating any one of the corresponding hydraulic actuators 2*tr*L, 2*tr*R, 8*bmc*, 8*stc*, 8*bkc*, a control signal from the controller controls the valve to a fully open position so that the corresponding pump passage 31, 32 communicates with the tank 24. When the operator operates any hydraulic actuator 2*tr*L, 2*tr*R, 8*bmc*, 8*stc*, 8*bkc*, the corresponding solenoid valve 33, 34 moves to a closed position in proportion to the magnitude of the operating signal.

When at the left position as viewed in FIG. 1, the solenoid valve 35 enables hydraulic fluid to be fed from the two main pumps 17A, 17B to the hydraulic actuators 2*tr*L, 2*tr*R, 8*bmc*, 8*stc*, 8*bkc*. When the solenoid valve 35 is switched to the right position, i.e. the straight travel position, it permits one of the main pumps, i.e. the main pump 17B, to feed equally divided volume of hydraulic fluid to the two travel motors 2*tr*L, 2*tr*R, thereby enabling the work machine 1 to travel straight.

The hydraulic actuator control circuit 25 includes a travel control circuit 36 and a work equipment control circuit 37. The travel control circuit 36 serves to control hydraulic fluid fed from the main pumps 17A, 17B of the hybrid type drive system 10 to the travel motors 2*tr*L, 2*tr*R. The work equipment control circuit 37 serves to control hydraulic fluid fed from the main pumps 17A, 17B of the hybrid type drive system 10 to the hydraulic actuators 8*bmc*, 8*stc*, 8*bkc*, which serve to operate the work equipment 8.

The travel control circuit 36 includes solenoid valves 43, 44 for controlling direction and flow rate of hydraulic fluid provided respectively through travel motor hydraulic fluid feeding passages 41, 42. The travel motor hydraulic fluid feeding passages 41, 42 are drawn from the solenoid valve 35, which functions as a straight travel valve.

The work equipment control circuit 37 includes a boom control circuit 45, a stick control circuit 46, and a bucket control circuit 47. The boom control circuit 45 serves to control hydraulic fluid fed from the main pumps 17A, 17B of the hybrid type drive system 10 to the boom cylinder 8*bmc*. The stick control circuit 46 serves to control hydraulic fluid fed from the main pumps 17A, 17B of the hybrid type drive system 10 to the stick cylinder 8*stc*. The bucket control circuit 47 serves to control hydraulic fluid fed from the main pumps 17A, 17B of the hybrid type drive system 10 to the bucket cylinder 8*bkc*.

The boom control circuit 45 includes a solenoid valve 49 for controlling direction and flow rate of hydraulic fluid provided through a boom cylinder hydraulic fluid feeding passage 48. The boom cylinder hydraulic fluid feeding passage 48 is drawn from the solenoid valve 35, which functions as a straight travel valve. The solenoid valve 49 is provided with hydraulic fluid feed/discharge passages 51, 52, which respectively communicate with the head-side chamber and the rod-side chamber of the boom cylinder 8*bmc*.

A solenoid valve 53 that serves as a fall preventive valve is included in the head-side hydraulic fluid feed/discharge passage 51 so that when movement of the boom 8*bm* is stopped, the boom 8*bm* is prevented from descending due to its own weight by switching the solenoid valve 53 to a check valve position at the left side, at which the solenoid valve 53 functions as a check valve. A solenoid valve 54 that serves as a regeneration valve is disposed between the two hydraulic fluid feed/discharge passages 51, 52 so that a part of return fluid discharged from the head-side chamber of the boom cylinder 8*bmc* can be regenerated into the rod-side chamber by switching the solenoid valve 54 to the check valve position when the boom is lowered.

A return fluid passage 55 that permits the fluid discharged from the boom cylinder 8*bmc* to branch off is provided at the tank passage side of the solenoid valve 49. The return fluid passage 55 comprises two return passages 56, 57, which are provided with a flow rate ratio control valve 58, 59 for controlling a ratio of fluid that branches off into the return passages 56, 57. The flow rate ratio control valve 58, 59 is comprised of two flow control solenoid valves: a solenoid valve 58 disposed in the return passage 56, which is provided with the aforementioned energy recovery motor 26, and a solenoid valve 59 disposed in the return passage 57, which branches off the upstream side of the solenoid valve 58.

A boom assist pump 84*as* for assisting flow rate of hydraulic fluid is connected to the boom cylinder hydraulic fluid feeding passage 48, which serves to feed hydraulic fluid from the main pump 17A of the hybrid type drive system 10 to the boom cylinder 8*bmc*. The boom assist pump 84*as* is connected to the boom cylinder hydraulic fluid feeding passage 48 through a boom assist hydraulic fluid feeding passage 85, which serves as a discharge passage.

The aforementioned boom motor generator 87 is connected to the energy recovery motor 26 provided in the return passage 56, through which return fluid discharged from the boom cylinder 8*bmc* flows. The boom motor generator 87 is adapted to be driven by the energy recovery motor 26 so as to function as a generator for feeding electric power to the electric power storage device 23 of the hybrid type drive system 10 as well as driven by electric power fed from the electric power storage device 23 so as to function as an electric motor. The boom motor generator 87 is connected through a clutch 88 to the boom assist pump 84*as*. The clutch 88 serves to transmit electric power from the boom motor generator 87 to the boom assist pump 84*as* when the boom motor generator 87 functions as an electric motor. When the boom motor generator 87 functions as a generator, the clutch 88 serves to disengage the boom motor generator 87 from the boom assist pump 84*as*.

When the energy recovery motor 26 is in operation, its rotation speed is controlled by the flow rate of return fluid in the return passage 56, the aforementioned flow rate being controlled by the flow rate ratio control valve 58, 59, so that electric power is fed from the boom motor generator 87 driven by this energy recovery motor 26 to the electric power storage device 23 of the hybrid type drive system 10 and stored therein.

It is desirable for the energy recovery motor 26 to function when the solenoid valve 49, which is provided for controlling direction and flow rate of hydraulic fluid, is positioned at the right chamber position as viewed in FIG. 1. In other words, it is desirable that when the boom is lowered, the hydraulic fluid feed/discharge passage 51 at the head-side of the boom cylinder 8*bmc* communicate with the return fluid passage 55 so as to permit the return fluid discharged from the head-side of the boom cylinder 8*bmc* to drive the energy recovery motor 26 well within its capacity because of the dead weight of the boom.

The stick control circuit 46 includes a solenoid valve 62 for controlling direction and flow rate of hydraulic fluid provided through a stick cylinder hydraulic fluid feeding passage 61. The stick cylinder hydraulic fluid feeding passage 61 is drawn from the solenoid valve 35, which functions as a straight travel valve. The solenoid valve 62 is provided with hydraulic fluid feed/discharge passages 63,64, which respectively communicate with the head-side chamber and the rod-side chamber of the stick cylinder 8*stc*. A solenoid valve 65 that serves as a regeneration valve for returning fluid from the rod side to the head side is disposed between the two hydraulic fluid feed/discharge passages 63, 64 so that a part of return fluid discharged from the rod-side chamber of the stick cylinder 8*stc* can be regenerated into the head-side chamber by switching the solenoid valve 65 to the check valve position when the stick is lowered by stick-in operation.

The bucket control circuit 47 includes a solenoid valve 67 for controlling direction and flow rate of hydraulic fluid provided through a bucket cylinder hydraulic fluid feeding passage 66. The bucket cylinder hydraulic fluid feeding passage 66 is drawn from the solenoid valve 35, which functions as a straight travel valve. The solenoid valve 67 is provided with hydraulic fluid feed/discharge passages 68, 69, which respectively communicate with the head-side chamber and the rod-side chamber of the bucket cylinder 8*bkc*.

A circuit-to-circuit communicating passage 71 between stick and boom is disposed between the stick cylinder hydraulic fluid feeding passage 61 and the head-side of the boom cylinder 8*bmc* and thereby provides fluid communication between them. A solenoid valve 72 between stick and boom is disposed in the circuit-to-circuit communicating passage 71 between stick and boom. The solenoid valve 72 is adapted to be moved between a position for enabling flow in one direction from the stick cylinder hydraulic fluid feeding passage 61 to the head-side of the boom cylinder 8*bmc* and a position for interrupting the flow of fluid.

A circuit-to-circuit communicating passage 73 between bucket and stick is disposed between the boom cylinder hydraulic fluid feeding passage 48 and the stick cylinder hydraulic fluid feeding passage 61 and thereby provides fluid communication between them. A solenoid valve 74 between bucket and stick is disposed in the circuit-to-circuit communicating passage 73 between bucket and stick. The solenoid valve 74 is adapted to be moved between a position for enabling flow in one direction from the boom cylinder hydraulic fluid feeding passage 48 to the stick cylinder 8*stc* and a position for interrupting the flow of fluid.

A solenoid valve 89 between bucket and boom is disposed in the boom cylinder hydraulic fluid feeding passage 48, at a location between the branching point of the bucket cylinder hydraulic fluid feeding passage 66 and the joining point of the passage from the boom assist pump 84*as*. The solenoid valve 89 between bucket and boom is adapted to be switched between a position for enabling the hydraulic fluid that would otherwise be fed to the bucket cylinder 8*bkc* to be fed to the boom cylinder 8*bmc* in a one-way direction and a position for interrupting the flow of fluid.

A swing control circuit 91 that functions as a swing drive device is provided as a separate circuit for a hydraulic actuator control circuit 25. The swing control circuit 91 serves to control hydraulic fluid fed to the swing motor 4*swh*, which is provided to rotate the upper structure 4 (referred to as a "load" in claims and the summary of the invention) through a swing deceleration mechanism 4*gr*.

The swing control circuit 91 includes a solenoid valve 94 and a swing pump motor 95, wherein the solenoid valve 94 is connected to closed circuits 92, 93 of the swing motor 4*swh*, and the swing pump motor 95 is connected through the solenoid valve 94 to the closed circuits 92, 93. The solenoid valve 94 serves as a directional control valve that is also capable of flow control. The swing pump motor 95 serves as a pump for feeding hydraulic fluid to the swing motor 4*swh* and also as a hydraulic motor driven by hydraulic fluid discharged from the swing motor 4*swh*.

The solenoid valve 94 has a function of a restrictor valve whose aperture can be incrementally adjusted between two fully open positions with a neutral position therebetween. The two fully open positions are for rotation to the right and rotation to the left, respectively. When the solenoid valve 94 is at the neutral position, the passage between the swing pump motor 95 and the swing motor 4*swh* is interrupted.

A swing motor generator 96 is connected to the swing pump motor 95. The swing motor generator 96 is connected to a swing motor generator controller 96*c*, which may be an inverter or the like and is connected to the electric power storage device 23 of the hybrid type drive system 10.

When rotation of the upper structure 4 is being braked, the swing pump motor 95 functions as a hydraulic motor to drive the swing motor generator 96 so that the swing motor generator 96 functions as a generator for feeding electric power to the electric power storage device 23 of the hybrid type drive system 10. The swing motor generator 96 is also adapted to be driven by electric power fed from the electric power storage device 23, and, as a result, function as an electric motor to drive the swing pump motor 95 as a pump.

In other words, the electric power storage device 23 serves to store electric power fed from the swing motor generator 96 when the swing motor generator 96 functions as a generator, and feed electric power to the swing motor generator 96 when the swing motor generator 96 functions as an electric motor.

An exterior-connecting passage 97 for feeding hydraulic fluid to the hydraulic actuators that are outside the swing system, in other words the hydraulic actuators 2*tr*L, 2*tr*R, 8*bmc*, 8*stc*, 8*bkc* of the lower structure 2 and the work equipment 8, is drawn from a pipeline between the swing pump motor 95 and the solenoid valve 94.

A connecting passage solenoid valve 98 is disposed in the exterior-connecting passage 97 and adapted so that its aperture can be adjusted between a one-way direction flow position for enabling the supply of fluid to the hydraulic actuators 2*tr*L, 2*tr*R, 8*bmc*, 8*stc*, 8*bkc* of the lower structure 2 and the work equipment 8 and a position for interrupting the flow of fluid.

A hydraulic fluid replenishment pump 99 that serves as a hydraulic fluid replenishment means for replenishing hydraulic fluid is connected to the pipeline between the swing pump motor 95 and the solenoid valve 94.

A pump-to-pump communicating passage 101 is provided between the boom assist hydraulic fluid feeding passage 85 of the boom assist pump 84*as* and the discharge passage 31 of the main pump 17A, which may otherwise referred to as a first main pump, so that the pump-to-pump communicating passage 101 provides fluid communication between the two passages. A solenoid valve 102 between pumps is disposed in the pump-to-pump communicating passage 101. The solenoid valve 102 is adapted to be moved between a position for enabling flow in one direction from the boom assist hydraulic fluid feeding passage 85 of the boom assist pump 84*as* to the discharge passage 31 of the main pump 17A and a position for interrupting the flow of fluid.

Each one of the solenoid valves 53, 54, 65, 72, 74, 89, 98, 102 is a selector valve that incorporates a check valve and is capable of controlling flow rate.

Each one of the various solenoid valves 33, 34, 35, 43, 44, 49, 53, 54, 58, 59, 62, 65, 67, 72, 74, 89, 94, 98, 102 has a return spring (not shown) and a solenoid that is adapted to be proportionally controlled by a controller (not shown) so that each solenoid valve is controlled to a position to achieve a balance between excitation force of the solenoid and restorative force of the spring.

Next, the operations and effects of the embodiment shown in the drawings are explained hereunder.

When rotating the upper structure 4 on the lower structure 2 of the work machine 1, the solenoid valve 94 is controlled to a directional control position for rotation to the right or rotation to the left, while the swing motor 4*swh* is driven by hydraulic pressure generated by the swing pump motor 95, which is driven by electric power fed from the electric power storage device 23 of the hybrid type drive system 10 through the swing motor generator 96. Thus, the upper structure 4 can be rotated solely and independently by the swing system. During braking operation to stop the upper structure 4, the connecting passage solenoid valve 98 is closed so that hydraulic fluid discharged from the swing motor 4*swh* as a result of the pumping function of the swing motor 4*swh* rotated by inertial movement of the upper structure 4 operates the swing pump motor 95 as a hydraulic motor load, thereby making the swing motor generator 96 function as a generator. It is thus possible to transform inertial motion energy of the upper structure 4 to electric energy, thereby effectively recovering electric power to the electric power storage device 23 of the hybrid type drive system 10 while braking rotation movement of the upper structure 4.

When the swing motor 4*swh* does not require a great amount of hydraulic fluid, the solenoid valve 94 and the connecting passage solenoid valve 98 are adjusted closer to the neutral position and the one-way direction flow position respectively, so that the swing pump motor 95 is driven as a pump by the swing motor generator 96 functioning as an electric motor. As a result, while being replenished with hydraulic fluid by the hydraulic fluid replenishment pump 99, the swing pump motor 95 discharges hydraulic fluid through the connecting passage solenoid valve 98 to the exterior-connecting passage 97, thereby enabling the hydraulic fluid to be directly fed to the hydraulic actuator control circuit 25 of the lower structure 2 and the work equipment 8.

To be more specific, as the exterior-connecting passage 97 is connected to the discharge passage 32 of the main pump 17B, which feeds hydraulic fluid to the boom cylinder 8*bmc*, the stick cylinder 8*stc*, and the travel motors 2*tr*L, 2*tr*R, a sufficient amount of hydraulic fluid is fed to these hydraulic actuators from the main pumps 17A, 17B, as well as the swing pump motor 95 functioning as a pump. As the swing pump motor 95 can function as a pump, the main pumps 17A, 17B can be made correspondingly compact.

When controlling hydraulic fluid fed from the main pumps 17A, 17B of the hybrid type drive system 10 to the travel motors 2*tr*L, 2*tr*R, the boom cylinder 8*bmc*, the stick cylinder 8*stc*, and the bucket cylinder 8*bkc*, the hydraulic actuator control circuit 25 disengages the clutch 88 so that the energy recovery motor 26 driven by return fluid discharged from the boom cylinder 8*bmc* efficiently inputs driving power to the boom motor generator 87, which is under no-load condition and that the generated electric power is stored in the electric power storage device 23 of the hybrid type drive system 10. It is thus possible to effectively recover energy of return fluid discharged from the boom cylinder 8*bmc*.

The configuration described above is particularly beneficial when the boom 8*bm* of the work equipment 8 descends due to its own weight, because the energy recovery motor 26 enables the energy of the return fluid discharged from the head side of the boom cylinder 8*bmc* to be absorbed by the boom motor generator 87 and stored in the electric power storage device 23 of the hybrid type drive system 10.

When the clutch 88 is engaged, electric power fed from the electric power storage device 23 of the hybrid type drive system 10 enables the boom motor generator 87 to function as an electric motor to drive the boom assist pump 84*as* so that hydraulic fluid is fed from the boom assist pump 84*as* to the boom cylinder 8*bmc*. As a great amount of hydraulic fluid is thus fed to the boom cylinder 8*bmc* from four pumps, i.e. the boom assist pump 84*as* in addition to the main pumps 17A, 17B and the swing pump motor 95 functioning as a pump, the speed of boom raising action is further increased, resulting in increased working efficiency.

The return fluid discharged from the boom cylinder 8*bmc* into the return fluid passage 55 is divided into the return passage 56 and the return passage 57, and the proportion of divided flows of the fluid is controlled by the flow rate ratio control valve 58, 59. With its flow rate being controlled by the flow rate ratio control valve 58, 59, the fluid in the return passage 56 drives the energy recovery motor 26 so that the energy recovery motor 26 drives the boom motor generator 87 to feed electric power to the electric power storage device 23 of the hybrid type drive system 10. With the configuration as above, the hybrid type drive system 10 according to the present invention is capable of gradually increasing the flow rate ratio of the fluid distributed towards the energy recovery motor 26 from the moment when return fluid starts to flow from the boom cylinder 8*bmc*, thereby preventing occurrence of shock, as well as ensuring stable function of the boom cylinder 8*bmc* by preventing a sudden change in load to the boom cylinder 8*bmc*.

In other words, when the boom 8*bm* of the work equipment 8 descends due to its own weight, gradual increase of the flow rate ratio of the return fluid distributed from the head side of the boom cylinder 8*bmc* towards the energy recovery motor 26 enables the energy recovery motor 26 to smoothly absorb the energy of the return fluid, and the prevention of a sudden change in load to the boom cylinder 8*bmc* stabilizes the descending action of the boom 8*bm* due to its own weight.

The solenoid valve 58 and the solenoid valve 59 of the flow rate ratio control valve 58, 59 may each be disposed at desired, separate locations in the return passage 56 and the return passage 57 respectively. Furthermore, the flow rate ratio control valve 58, 59 is capable of controlling return fluid flowing towards the energy recovery motor 26 at a desired flow rate and flow rate ratio by controlling an aperture of each respective return passage 56, 57 separately and independently of each other.

As the solenoid valve 89 between bucket and boom is disposed in the boom cylinder hydraulic fluid feeding passage 48, a combined amount of hydraulic fluid can be fed from the first main pump 17A and the boom assist pump 84*as* to the boom cylinder 8*bmc* by opening the solenoid valve 89. Therefore, it is possible to increase the speed of boom raising action by the boom cylinder 8*bmc* and improve working efficiency. Furthermore, a high pressure to the bucket cylinder 8*bkc* can be ensured by closing the solenoid valve 89.

As the solenoid valve 72 between stick and boom is disposed in the circuit-to-circuit communicating passage 71 between stick and boom for linking the stick cylinder hydraulic fluid feeding passage 61 and the head-side of the boom cylinder 8*bmc*, controlling the solenoid valve 72 to the one-way direction flow position enables hydraulic fluid to be fed from the main pump 17B, which may otherwise be referred to as the second main pump, through the solenoid valve 72 to the head-side of the boom cylinder 8*bmc*, in addition to the hydraulic fluid that is fed from the first main pump 17A and the boom assist pump 84*as* through the left chamber of the solenoid valve 49 to the head-side of the boom cylinder 8*bmc*, thereby increasing the speed of boom raising action by the boom cylinder 8*bmc* and improving working efficiency. Furthermore, supply of hydraulic fluid from the second main pump 17B to the stick cylinder 8*stc* can be ensured by closing the solenoid valve 72.

As the solenoid valve 74 between bucket and stick is disposed in the circuit-to-circuit communicating passage 73 between bucket and stick, opening the solenoid valve 74 to the one-way direction flow position and closing the solenoid valves 72, 89 enables hydraulic fluid that would otherwise be fed from the first main pump 17A to the boom cylinder 8*bmc* to merge with the hydraulic fluid fed from the second main pump 17B to the stick cylinder 8*stc*, thereby increasing the speed of the stick cylinder 8*stc*. Furthermore, closing the solenoid valve 74 between bucket and stick and opening the solenoid valves 72, 89 enables hydraulic fluid that would otherwise be fed from the second main pump 17B to the stick cylinder 8*stc* to merge with the hydraulic fluid fed from the first main pump 17A to the head-side of the boom cylinder 8*bmc* through the boom cylinder hydraulic fluid feeding passage 48, the solenoid valve 89, and the left chamber of the solenoid valve 49, thereby increasing the speed of boom raising action. Thus, working efficiency can be improved.

When the solenoid valve 74 between bucket and stick is controlled at the flow interruption position so that the boom control circuit 45 and the stick control circuit 46 can function independently of each other, it is possible to separate the boom system and the stick system and control pressures in the two independently of each other. Furthermore, a high pressure to the bucket cylinder 8*bkc* can be ensured by closing the solenoid valve 89 as well as the solenoid valve 74.

The solenoid valve 102 between pumps is provided in the pump-to-pump communicating passage 101. Therefore, when hydraulic fluid is not required for boom raising, opening the solenoid valve 102 enables the hydraulic fluid discharged from the boom assist pump 84*as* to be combined with hydraulic fluid from the first main pump 17A, resulting in improved working efficiency. Furthermore, supply of a desired amount of hydraulic fluid to the boom cylinder 8*bmc* can be ensured by closing the solenoid valve 102.

As a result of the configuration that allows opening or closing the connecting passage solenoid valve 98 in addition to operation of the solenoid valve 72 between stick and boom, the solenoid valve 74 between bucket and stick, the solenoid valve 89 between bucket and boom, and the solenoid valve 102 between pumps described above, the flexibility allowed in the combination of circuits that support each other with hydraulic fluid is increased, making it easy to cope with demands for a wide variety of operation patterns.

The boom control circuit 45 can be completely separated from the main pumps 17A, 17B by closing the solenoid valves 72, 89, 102 to their respective flow interruption positions.

As described above, a variety of combinations of switched positions of the solenoid valves 72, 74, 89, 98, 102 increases flexibility of the combination of control circuits, resulting in flexibility of the system configuration. Furthermore, using a hybrid system enables improved fuel efficiency of the engine 11.

The present invention is applicable to swing-type work machines, such as a hydraulic excavator.

The invention claimed is:

1. A work machine comprising:

a lower structure provided with a travel motor adapted to function by receiving hydraulic fluid;

an upper structure that is rotatable on the lower structure by a swing motor functioning by receiving hydraulic fluid;

work equipment mounted on the upper structure;

a hybrid type drive system comprising:

an engine;

a motor generator adapted to be driven by the engine so as to function as a generator as well as receive electric power so as to function as an electric motor;

an electric power storage device that serves to store electric power fed from the motor generator functioning as a generator, as well as feed electric power to the motor generator functioning as an electric motor; and a main pump driven by either one of or both the engine and the motor generator;

a hydraulic actuator control circuit for controlling hydraulic fluid fed from the main pump of the hybrid type drive system to hydraulic actuators of the lower structure as well as hydraulic actuators of the work equipment;

a swing drive device rotating the upper structure by controlling hydraulic fluid fed to the swing motor, comprising:

a swing pump motor connected to the swing motor through a closed circuit and adapted to function as a pump for feeding hydraulic fluid to the swing motor and also function as a hydraulic motor driven by hydraulic fluid discharged from the swing motor;

a directional control valve having a neutral position and a directional control position, the neutral position being a position at which the directional control valve interrupts a passage between the swing pump motor and the swing motor;

a swing motor generator functioning as a generator by being driven by the swing pump motor when the swing pump motor is functioning as a hydraulic motor during braking operation of rotation of the load, the swing motor generator also functioning as an electric motor by receiving electric power so as to drive the swing pump motor as a pump;

the electric power storage device also storing electric power fed from the swing motor generator when the swing motor generator is functioning as a generator, electric power storage device also serving to feed electric power to the swing motor generator when the swing motor generator is functioning as an electric motor;

an exterior-connecting passage feeding hydraulic fluid from the closed circuit between the swing pump motor and the directional control valve to components outside a swing system;

a connecting passage solenoid valve disposed in the exterior-connecting passage and adapted to be moved between a position for enabling supply of fluid to components outside the swing system and a position for interrupting the flow of fluid; and a hydraulic fluid replenishment device replenishing hydraulic fluid in the closed circuit between the swing pump motor and the directional control valve;

wherein the work equipment comprises a boom, a stick, and a bucket that are sequentially connected and adapted to be pivoted by a boom cylinder, a stick cylinder and a bucket cylinder respectively;

wherein the hydraulic actuator control circuit serves to control hydraulic fluid fed from the main pumps of the hybrid type drive system to the travel motor of the lower structure as well as to the boom cylinder, the stick cylinder, and the bucket cylinder of the work equipment;

wherein the exterior-connecting passage is connected to a discharge passage of the main pump, which serves to feed hydraulic fluid to the boom cylinder, the stick cylinder, and the travel motor;

wherein the hydraulic actuator control circuit comprises:

a boom assist pump for assisting flow rate of hydraulic fluid fed from the main pump of the hybrid type drive system to the boom cylinder;

an energy recovery motor provided in a return passage through which return fluid discharged from the boom cylinder flows;

a boom motor generator driven by the energy recovery motor so as to function as a generator for feeding electric power to the electric power storage device of the hybrid type drive system as well as be driven by electric power fed from the electric power storage device so as to function as an electric motor; and a clutch transmitting electric power from the boom motor generator to the boom assist pump when the boom motor generator is functioning as an electric motor and disengage the boom motor generator from the boom assist pump when the boom motor generator is functioning as a generator.

2. A swing drive device as claimed in claim 1, wherein:

a hydraulic fluid replenishment pump serves as the hydraulic fluid replenishment means.

3. A work machine claimed in claim 1, wherein the hydraulic actuator control circuit further includes:

a circuit-to-circuit communicating passage between stick and boom for providing fluid communication between a hydraulic fluid feeding passage for the stick cylinder and a head-side of the boom cylinder; and a solenoid valve between stick and boom, the solenoid valve between stick and boom being disposed in the circuit-to-circuit communicating passage between stick and boom and adapted to be moved between a position for enabling flow in one direction from the hydraulic fluid feeding passage for the stick cylinder to the head-side of the boom cylinder and a position for interrupting the flow of fluid.

4. A work machine claimed in claim 3, wherein:

a first main pump and a second main pump are provided and serve as the aforementioned main pump; and the hydraulic actuator control circuit further includes:

a boom cylinder hydraulic fluid feeding passage for feeding hydraulic fluid from the first main pump to the boom cylinder, a bucket cylinder hydraulic fluid feeding passage that branches off the boom cylinder hydraulic fluid feeding passage and serves to feed hydraulic fluid to the bucket cylinder, a stick cylinder hydraulic fluid feeding passage for feeding hydraulic fluid from the second main pump to the stick cylinder, a boom assist pump that serves, together with the first main pump, to feed hydraulic fluid to the boom cylinder, a solenoid valve between bucket and boom disposed in the boom cylinder hydraulic fluid feeding passage, at a location between a branching point of the bucket cylinder hydraulic fluid feeding passage and a point at which a passage from the boom assist pump joins the boom cylinder hydraulic fluid feeding passage, the solenoid valve between bucket and boom being adapted to be moved between a position for enabling the hydraulic fluid that would otherwise be fed to the bucket cylinder to be fed to the boom cylinder in a one-way direction and a position for interrupting the flow of fluid, a circuit-to-circuit communicating passage between bucket and stick for providing fluid communication between the bucket cylinder hydraulic fluid feeding passage and the stick cylinder hydraulic fluid feeding passage, a solenoid valve between bucket and stick, the solenoid valve between bucket and stick being disposed in the circuit-to-circuit communicating passage between bucket and stick and adapted to be moved between a position for enabling flow in one direction from the bucket cylinder hydraulic fluid feeding passage for the stick cylinder and a position for interrupting the flow of fluid, a pump-to-pump communicating passage for providing fluid communication between a discharge passage of the boom assist pump and the discharge passage of the first main pump, and a solenoid valve between pumps that is disposed in the pump-to-pump communicating passage and adapted to be moved between a position for enabling flow in one direction from the discharge passage of the boom assist pump to the discharge passage of the first main pump and a position for interrupting the flow of fluid.

5. A work machine claimed in claim 1, wherein:

a first main pump and a second main pump are provided and serve as the aforementioned main pump; and the hydraulic actuator control circuit further includes:

a boom cylinder hydraulic fluid feeding passage for feeding hydraulic fluid from the first main pump to the boom cylinder, a bucket cylinder hydraulic fluid feeding passage that branches off the boom cylinder hydraulic fluid feeding passage and serves to feed hydraulic fluid to the bucket cylinder, a stick cylinder hydraulic fluid feeding passage for feeding hydraulic fluid from the second main pump to the stick cylinder, wherein the boom assist pump serves, together with the first main pump, to feed hydraulic fluid to the boom cylinder, a solenoid valve between bucket and boom disposed in the boom cylinder hydraulic fluid feeding passage, at a location between a branching point of the bucket cylinder hydraulic fluid feeding passage and a point at which a passage from the boom assist pump joins the boom cylinder hydraulic fluid feeding passage, the solenoid valve between bucket and boom being adapted to be moved between a position for enabling the hydraulic fluid that would otherwise be fed to the bucket cylinder to be fed to the boom cylinder in a one-way direction and a position for interrupting the flow of fluid, a circuit-to-circuit communicating passage between bucket and stick for providing fluid communication between the bucket cylinder hydraulic fluid feeding passage and the stick cylinder hydraulic fluid feeding passage, a solenoid valve between bucket and stick, the solenoid valve between bucket and stick being disposed in the circuit-to-circuit communicating passage between bucket and stick and adapted to be moved between a position for enabling flow in one direction from the bucket cylinder hydraulic fluid feeding passage for the stick cylinder and a position for interrupting the flow of fluid, a pump-to-pump communicating passage for providing fluid communication between a discharge passage of the boom assist pump and the discharge passage of the first main pump, and a solenoid valve between pumps that is disposed in the pump-to-pump communicating passage and adapted to be moved between a position for enabling flow in one direction from the discharge passage of the boom assist pump to the discharge passage of the first main pump and a position for interrupting the flow of fluid.

* * * * *